US008787120B2

(12) United States Patent
Fleury et al.

(10) Patent No.: US 8,787,120 B2
(45) Date of Patent: Jul. 22, 2014

(54) EXTERIOR ELEMENT FOR A WRISTWATCH

(75) Inventors: Emmanuel Fleury, Moutier (CH); Martin Bisig, Zuchwil (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 177 days.

(21) Appl. No.: 13/386,863

(22) PCT Filed: Aug. 2, 2010

(86) PCT No.: PCT/EP2010/061209

§ 371 (c)(1), (2), (4) Date: Jan. 24, 2012

(87) PCT Pub. No.: WO2011/026700

PCT Pub. Date: Mar. 10, 2011

(65) Prior Publication Data

US 2012/0120776 A1 May 17, 2012

(51) Int. Cl.
*G04B 1/00* (2006.01)
*G04B 19/06* (2006.01)

(52) U.S. Cl.
USPC ..... 368/205; 368/232; 368/67

(58) Field of Classification Search
USPC ..... 368/228, 232, 67, 205
See application file for complete search history.

(56) References Cited

U.S. PATENT DOCUMENTS

| | | | | |
|---|---|---|---|---|
| 3,609,960 | A * | 10/1971 | Huther | 368/67 |
| 3,757,511 | A * | 9/1973 | Burgess et al. | 368/83 |
| 4,553,851 | A | 11/1985 | Matsumoto et al. | |
| 4,875,200 | A * | 10/1989 | Tillery | 368/67 |
| 5,734,627 | A * | 3/1998 | Sy | 368/67 |
| 7,079,453 | B2 * | 7/2006 | Minami et al. | 368/205 |
| 2001/0014618 | A1 | 8/2001 | Martin et al. | |
| 2006/0050618 | A1 | 3/2006 | Osa et al. | |

FOREIGN PATENT DOCUMENTS

| | | |
|---|---|---|
| DE | 38 19713 | 12/1989 |
| DE | 10 2004 014 788 | 10/2005 |
| EP | 1 574 919 | 9/2005 |
| FR | 2 538 573 | 6/1984 |
| JP | 2004 200189 | 7/2004 |

OTHER PUBLICATIONS

International Search Report Issued Nov. 22, 2010 in PCT/EP10/61209 Filed Aug. 2, 2010.

* cited by examiner

*Primary Examiner* — Sean Kayes
(74) *Attorney, Agent, or Firm* — Oblon, Spivak, McClelland, Maier & Neustadt, L.L.P.

(57) ABSTRACT

An external element for a wristwatch, containing an electronic device and a power source for powering the electronic device with electric energy, wherein the electronic device and power source are integrated in the exterior element, to form an autonomous electronic module, which is completely independent of the wristwatch movement.

13 Claims, 8 Drawing Sheets

EXTERIOR ELEMENT FOR A WRISTWATCH

CROSS REFERENCE TO RELATED APPLICATIONS

The present application is a 35 U.S.C. §371 National Stage patent application of International patent application PCT/EP2010/061209, filed on Aug. 2, 2010, the text of which is incorporated by reference, and claims the benefit of the filing date of European Patent Application No. 09169173.3, filed on Sep. 1, 2009, the text of which is also incorporated by reference.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF THE MATERIAL ON THE COMPACT DISC

Not Applicable.

BACKGROUND OF THE INVENTION

1. Field of the Invention

The present invention concerns an exterior element for a wristwatch provided with at least one electronic function. More specifically, the present invention concerns an exterior element for a wristwatch provided with at least one electronic function which is completely autonomous relative to the watch movement.

2. Description of the Related Art Including Information Disclosed Under 37 CFR 1.97 and 1.98

The present invention particularly concerns wristwatches with mechanical movements, but is not limited thereto. The affection that users have for purely mechanical watches is known. However, persons who wear mechanical watches are deprived of the advantages that electronic functions can provide.

It is an object of the present invention to overcome this problem by providing a wristwatch with at least one electronic function, the operation of which is completely autonomous relative to that of the watch movement.

BRIEF SUMMARY OF THE INVENTION

The present invention therefore concerns a wristwatch dial, characterized in that at least one light source and one photovoltaic cell for powering the light source with electric energy are housed within the thickness of the dial, so as to form an autonomous electronic module, which is completely independent of the wristwatch movement.

According to yet another feature of the invention, if the power source includes at least one photovoltaic cell, the photovoltaic cell powers the electronic device via a rechargeable battery, which stores the energy produced by the photovoltaic cell and releases it when the electronic device is activated.

Owing to these features, the present invention provides a wristwatch including one or several electronic devices, the operation of which is completely autonomous relative to that of the watch. This proves particularly advantageous for a mechanical wristwatch. Indeed, the watch retains the emotional aspect provided by its purely mechanical operation, yet enjoys the addition of one or more electronic devices which enlarge the range of functions that it can offer its user. Of course, the present invention may equally well be applied to an electromechanical or purely electronic watch, provided that the electronic device(s) integrated in the exterior element are independent of the watch movement.

According to an alternative embodiment, the invention also concerns a bezel for a wristwatch, characterized in that the bezel defines an internal volume, which houses one or more series connected photovoltaic cells and at least one rechargeable battery, together with at least one electronic device.

BRIEF DESCRIPTION OF THE SEVERAL VIEWS OF THE DRAWINGS

Other features and advantages of the present invention will appear more clearly from the following detailed description of various embodiments of an exterior element of the invention, these examples being given solely by way of non-limiting illustration with reference to the annexed drawing, in which.

DETAILED DESCRIPTION OF THE INVENTION

The present invention proceeds from the general inventive idea which consists in integrating a light source and the associated power and control means within a wristwatch dial. The light source must be integrated such that the light source is completely autonomous relative to the watch movement. It is thus possible to associate one or more electronic functions with a purely mechanical watch, to enlarge the range of functions offered by the watch without detracting from the emotional aspect of a mechanical watch. If the wristwatch dial is removably mounted it is also possible to vary the functions proposed by the watch. Naturally, it is also possible to mount the dial of the invention in an electromechanical or even a purely electronic watch. The only condition to be satisfied is that the dial forms a completely autonomous electronic module relative to the watch movement. Various types of electronic devices, such as one or more ultraviolet radiation sources, a compass, an accelerometer or other devices may be envisaged.

Figure 1:
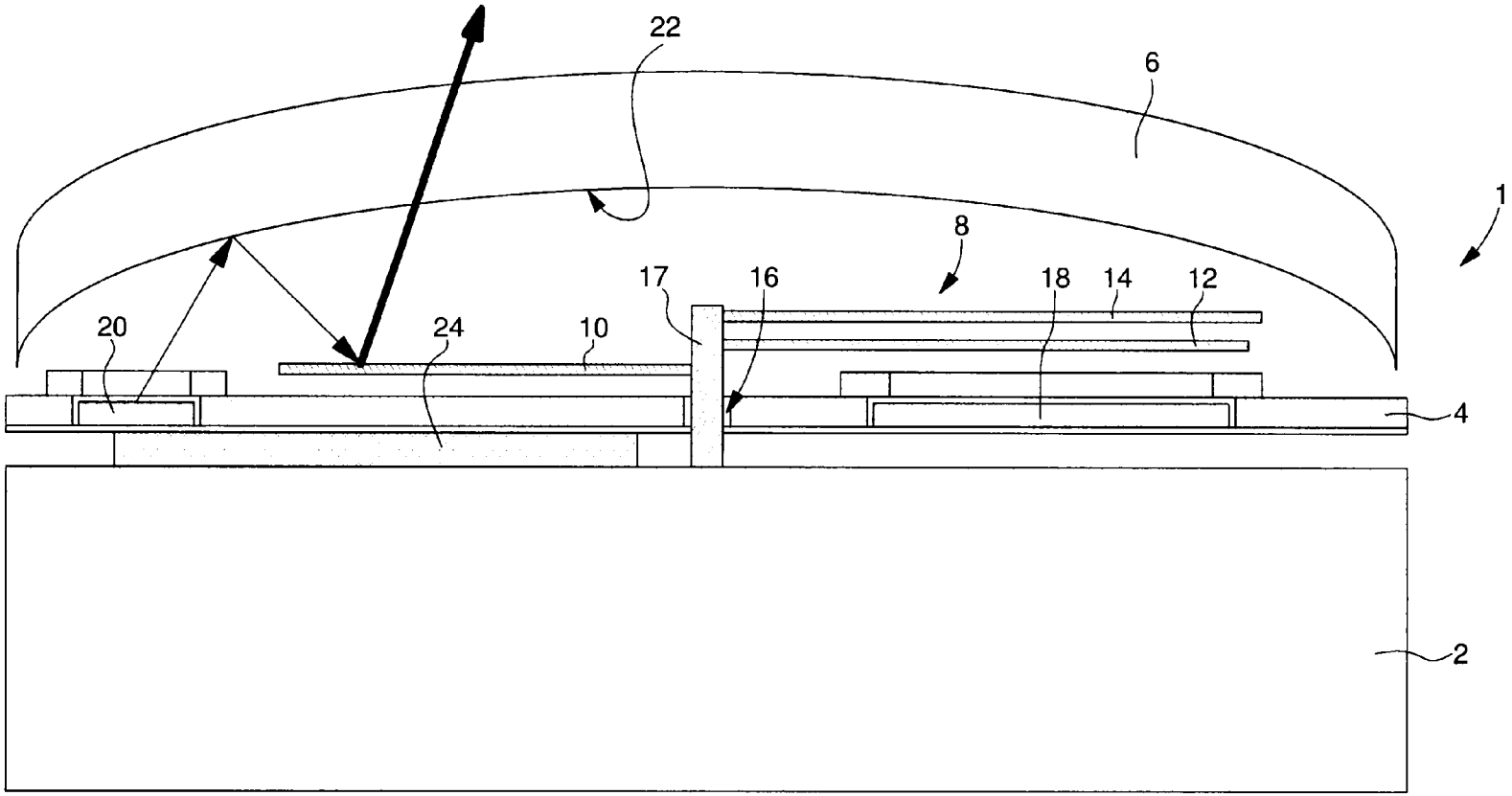
FIG. 1 is a schematic cross-section of a watch case including a dial, which, together with a photovoltaic cell, rechargeable battery and light source, forms an electronic module according to the invention, which is completely independent from the watch movement.

FIG. 1 is a schematic cross-section of a watch case according to the invention. In the following description, any elements identical to those described with reference to a preceding Figure will be designated by the same reference numerals. Designated as a whole by the general reference numeral 1, the watch case according to the invention includes a basic mechanical movement 2, above which there is arranged a dial 4, covered by a crystal 6. Movement 2 drives a set of hands 8 in a conventional manner, the set of hands including an hour hand 10, a minute hand 12 and a seconds hand 14. For this purpose, dial 4 has a through hole 16 at the centre thereof for the passage of the hour pipe 17.

According to the invention, at least one photovoltaic cell 18, for example made of single crystal silicon, is housed within the thickness of dial 4. The electric energy provided by photovoltaic cell 18, from the conversion of incident natural light, is used to power one or several light sources 20, which are also housed within the thickness of dial 4. There may be, for example, as many light sources 20 as there are hour symbols on dial 4. These light sources 20 may, for example, be ultraviolet radiation sources of the light emitting diode type. The ultraviolet light produced by these diodes is reflected by crystal 6 and lights up hour hand 10, minute hand 12 and seconds hand 14, which, for this purpose, will advantageously be coated with a layer of fluorescent or phosphorescent pigments. To improve the fluorescent or phosphorescent effect, the surface of crystal 6 which faces dial 4 may be coated with one or more thin layers 22 that reflect the ultraviolet light and allow most of the visible light spectrum to pass through.

The ultraviolet light produced by light sources 20 is reflected by crystal 6 towards hands 10, 12, 14 in order to light said hands. Via fluorescence and phosphorescence, the pigments deposited on the surface of the hands produce a visible light which is diffused through watch crystal 6.

The light source or sources 20 are powered directly or preferably via a rechargeable battery 24, by photovoltaic cell 18. Rechargeable battery 24 may be formed by a button cell, a thin film battery, supercapacitors or other device. Rechargeable battery 24 is mounted on the back surface of dial 4. It accumulates the electric energy produced by photovoltaic cell 18 and releases it to light sources 20 at the user's command, as explained in detail hereinafter. According to a variant that is not shown, photovoltaic cell 18 can be replaced by a non-rechargeable battery.

As will have been clear from the foregoing, with the components associated therewith, namely photovoltaic cell 18, rechargeable battery 24 and light sources 20, dial 4 forms a complete electronic module, which lights the hour symbols and hands 10, 12 and 14, and which is completely autonomous relative to the basic mechanical movement 2 of the watch according to the invention. The watch according to the invention maintains the purely mechanical appearance which gives it an emotional aspect, yet enjoys the addition of an electronic function which offers the user the possibility of an additional use. Of course, and according to a determining advantage of the invention, the addition of an electronic function to the watch does not require any modification or adaptation of any nature to be made to the mechanical movement. At most, the height of the hour hand 10, minute hand 12 and seconds hand 14 has to be slightly increased, to take account of the extra thickness of dial 4, which is around 1.0 to 1.5 millimeters.

Figure 2:
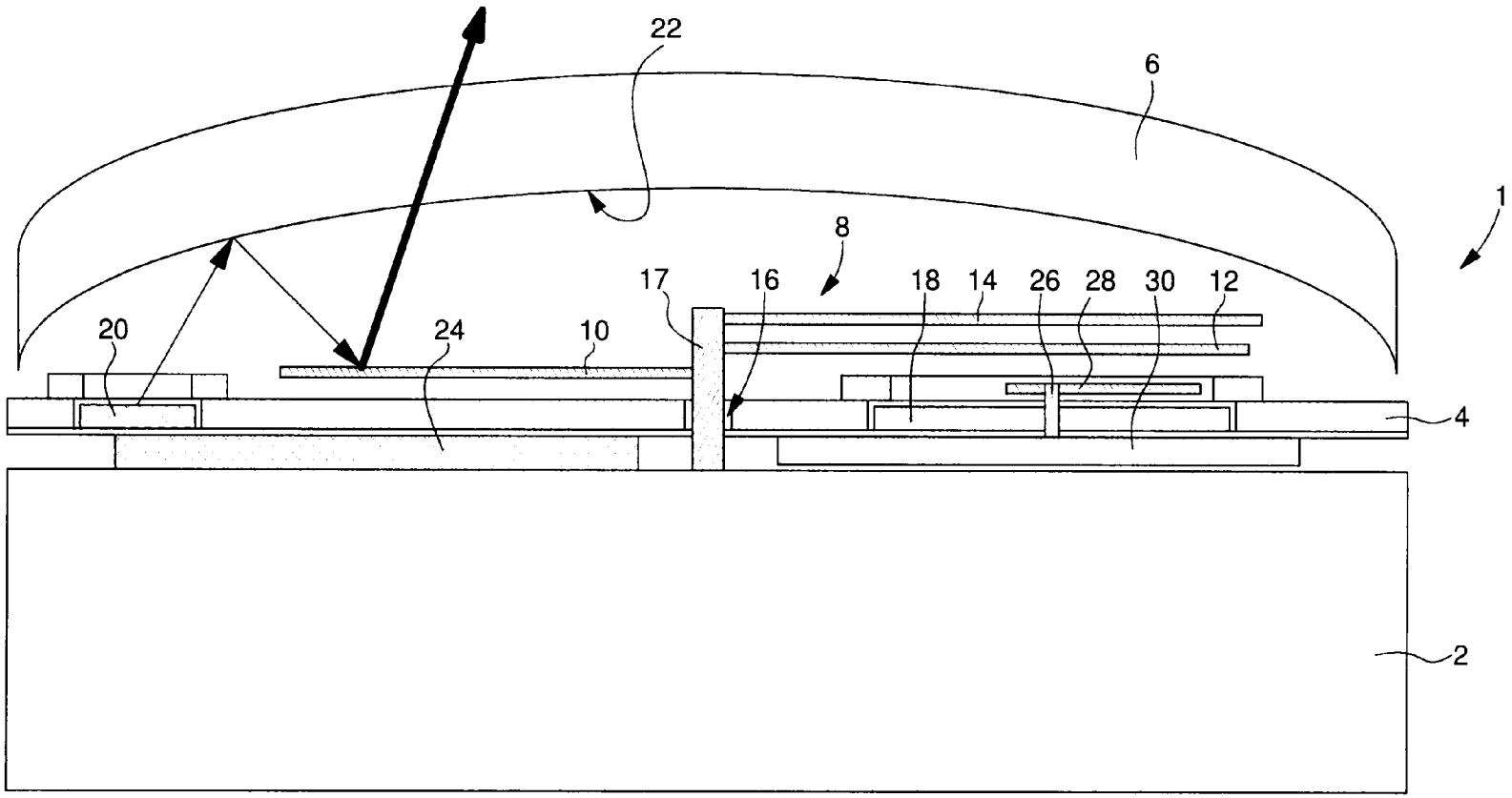
FIG. 2 is a similar view to that of FIG. 1, wherein an electronic compass function is housed in the dial, in addition to the lighting function.

FIG. 2 is a similar view to that of FIG. 1, which shows that an additional electronic function has been added, for example a compass. A hole has therefore been made in photovoltaic cell 18 for the passage of a pipe 26 of a hand 28. This hand 28 is driven via pipe 26 by a micromotor 30, which is mounted on the back surface of dial 4. This micromotor 30 may be a microelectronic mechanical system or MEMS. It may also be an ultra-flat Lavet motor, piezoelectric or other type of motor. Other examples of an additional electronic function may be envisaged, such as an altimeter, a temperature sensor and more generally a sensor for a physical magnitude.

Figure 3:
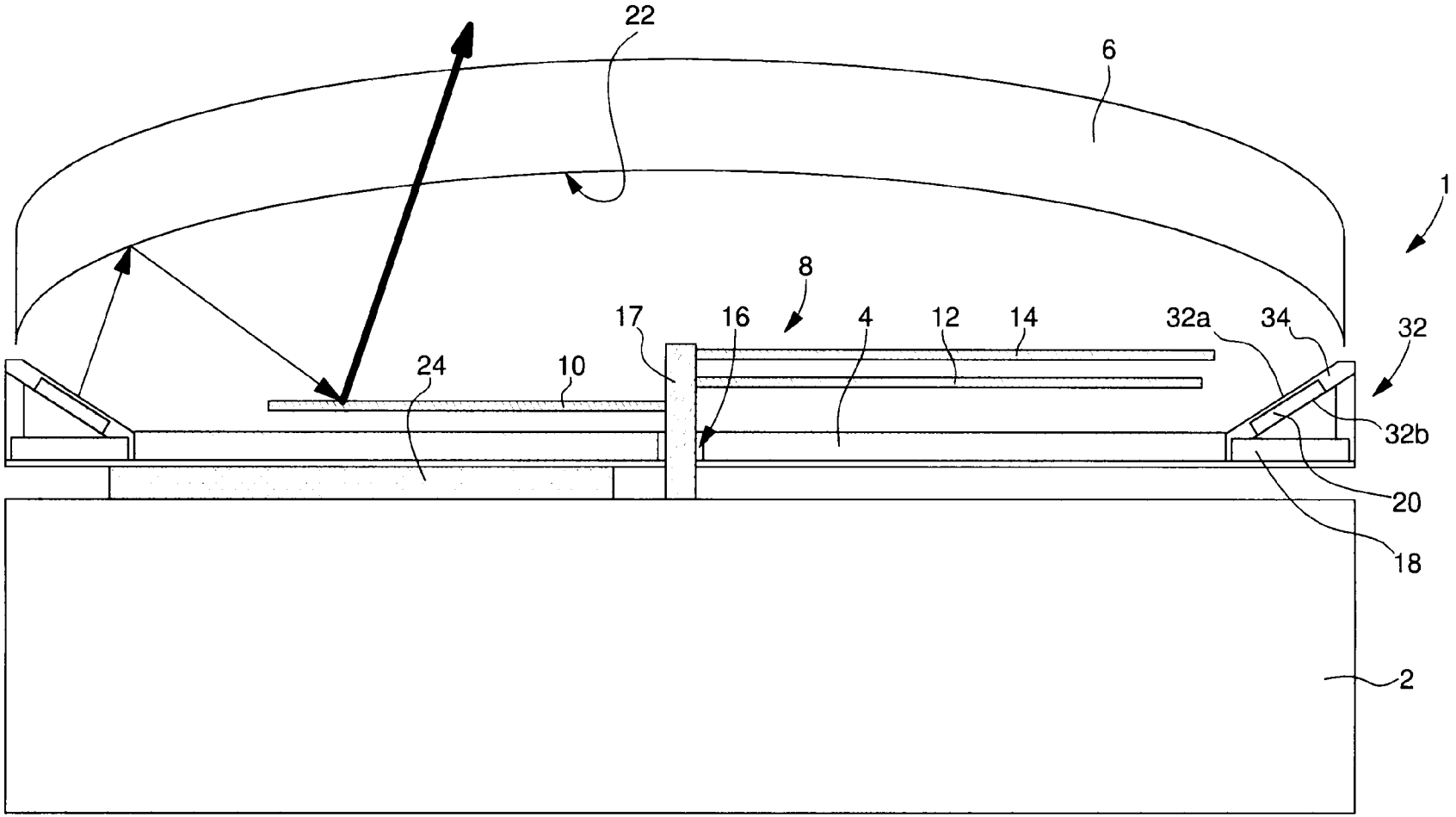
FIG. 3 is a schematic cross-section of a watch case including a dial, held by a flange, in which a photovoltaic cell and a light source are integrated.

FIG. 3 is a schematic diagram of another embodiment of the invention. According to this embodiment, photovoltaic cell 18 is arranged in an annular fashion on the external periphery of dial 4 and is concealed from the user's view by a semi-transparent flange 32, arranged obliquely, for example at 45° to the normal of dial 4. More specifically, flange 4 allows the ambient light to pass through its front face 32*a* which faces the user, so that the photoelectric effect can occur, but conceals photovoltaic cell 18, which is covered by the back face 32*b* of flange 32. The light source or sources 20 are integrated in the inclined plane 34 of flange 32.

Figure 4:
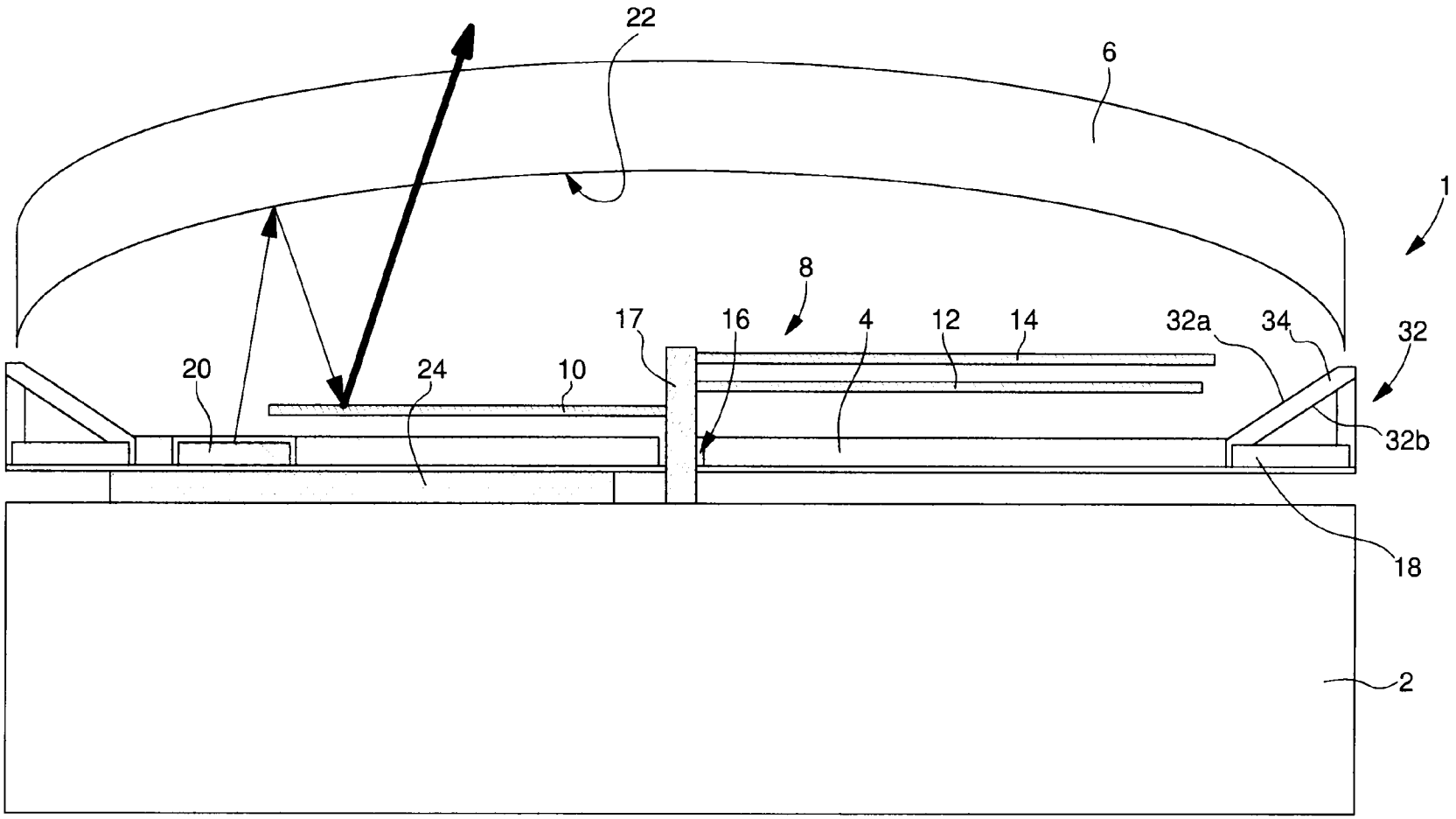
FIG. 4 is a similar view to that of FIG. 3, wherein the light source is integrated in the dial, in proximity to the leg of the flange.

FIG. 4 is a schematic diagram of an alternative embodiment of the invention illustrated in FIG. 3. According to this variant, photovoltaic cell 18 is arranged in an annular fashion along the external periphery of dial 4 and is masked from the user's view by a flange 32 having a cross section in the form of a right angled triangle, the inclined plane 34 of which covers photovoltaic cell 18. The inclined plane 34 of flange 32 is arranged obliquely, for example at 45° relative to the normal of dial 4. Flange 32 is semi-transparent: it allows the ambient light to pass through so that the photovoltaic effect can occur, but conceals photovoltaic cell 18 by diffusion, to make said cell invisible to the user. The light source or sources 20, which emit ultraviolet radiation, are housed within the thickness of dial 4, arranged in proximity to base 36 of flange 32. The ultraviolet light emitted by light sources 20 is reflected by crystal 6 onto hour hand 10, minute hand 12 and seconds hand 14. Excited by the ultraviolet light, the phosphorescent and fluorescent pigments emit luminous radiation within the wavelength range of visible light which passes through crystal 6.

Figure 5:
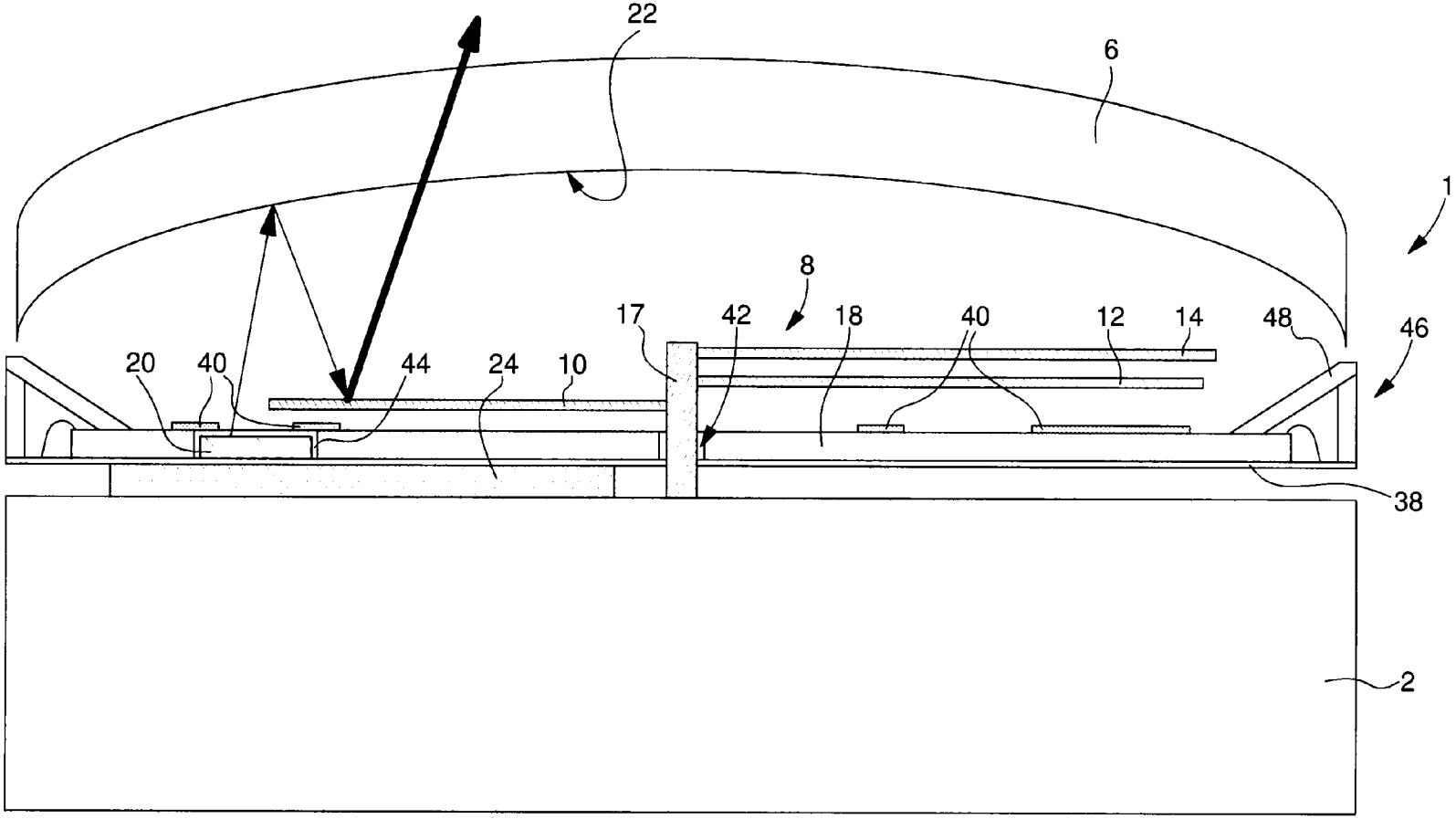
FIG. 5 is a schematic cross-section of a watch case according to the invention, including a dial, which is formed by a solar cell structured on a printed circuit and in which a light source is integrated.

FIG. 5 is a schematic diagram of yet another embodiment of the invention. According to this embodiment, the watch dial is formed by the actual photovoltaic cell 18, which is structured on a printed circuit 38, which may be made of a ceramic or epoxy material for reasons of solidity and rigidity. The appliques and other decorative designs 40 are added to the visible surface of photovoltaic cell 18 either by means of self adhesive elements or by silk screen printing. A through hole 42 is made in photovoltaic cell 18 for the passage of pipe 17 of hour hand 10. Photovoltaic cell 18 also has one or more cavities 44, the number of which matches the number of light sources 20. Light sources 20 are housed in these cavities 44. The dial formed by photovoltaic cell 18 is held in place by an ordinary flange 46, which does not need to be semi-transparent. Flange 46 has a cross section in the form of a right angled triangle and the inclined plane 48 thereof forms an angle of 45° with the normal to the photovoltaic cell 18 surface.

Until now, the invention has been described in relation to a watch dial which, with a photovoltaic cell, a rechargeable battery, one or more light sources, and where appropriate, a related function such as an electronic compass, forms an autonomous electronic module, which is completely independent of the watch movement. This dial may be fitted to any type of watch and, in particular, a mechanical watch, without requiring any modification to the watch movement, such that the mechanical watch keeps its emotional nature intact, while offering additional functions to the user. It goes without saying, however, that the dial according to the invention is not the only exterior element to which the present invention may be applied and that other exterior elements, such as a bezel, may also be converted into an independent module in accordance with the teaching of the present invention.

Figure 6B:
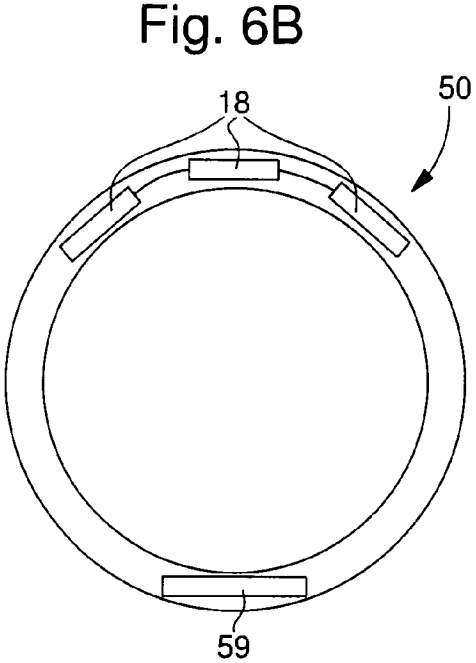
FIGS. 6A and 6B are cross-sectional and top views respectively of a bezel, in which a photovoltaic cell, supercapacitors and a liquid crystal cell are integrated to form a complete electronic module, which is totally autonomous from the watch movement.
Figure 6A:
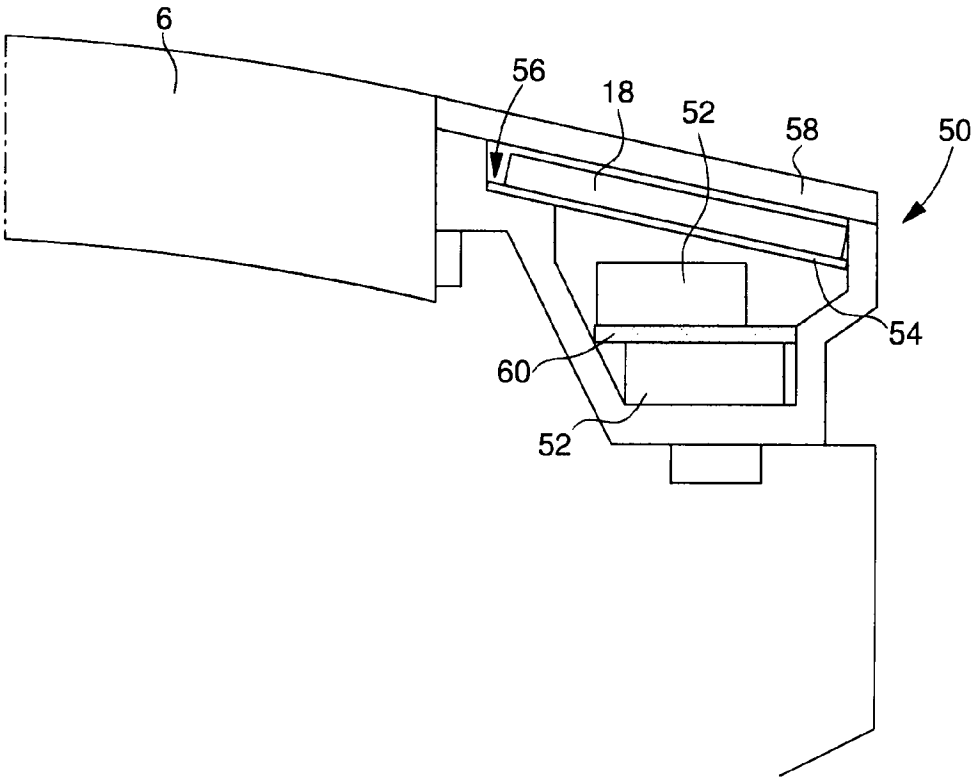

FIGS. 6A and 6B are cross-sectional and top views respectively of a bezel according to the invention, designated as a whole by the general reference numeral 50. Bezel 50, which is generally circular, defines an internal volume which houses at least one photovoltaic cell 18 and a plurality of rechargeable batteries 52. More specifically, there are preferably three photovoltaic cells 18, although this is not limiting. The three photovoltaic cells 18 are series connected and mounted on a substrate 54, which rests on an internal shoulder 56 of bezel 50. Photovoltaic cells 18 are mounted close to the top surface 58 of bezel 50, and underneath top surface 58. The top surface 58 of bezel 50 is transparent or semi-transparent, at least in the area where the three photovoltaic cells 18 are arranged.

Two rings of rechargeable batteries 52 are also housed in the internal volume of bezel 50, on both sides of a printed circuit 60. Rechargeable batteries 52 may be for example supercapacitors 52 which are surface mounted devices (SMD). The supercapacitors 52 of one ring are mounted in parallel and the two rings of supercapacitors 52 are mounted in parallel. These two rings of supercapacitors 52 are used for storing the electrical energy produced by photovoltaic cells 18 and releasing it, at the user's demand, to power the electronic device or devices housed in bezel 50. Of course, other types of rechargeable batteries can be envisaged, such as shaped or thin film batteries, which may or not be superposed on each other.

In the example shown in the drawing, the electronic device is a digital display device 59, such as a liquid crystal cell or a bistable cell which may, for example, be used for timing an activity. Bezel 50 may be fixedly or rotatably mounted. It may also be removably mounted to allow replacement by a bezel enclosing another electronic function.

In the simplified embodiment, the exterior element according to the present invention only includes one energy source and one electronic device powered by said energy source. It is possible to envisage one electronic device, such as a compass, operating continuously, powered by one or several photovoltaic cells.

However, according to the preferred embodiment of the invention, the electronic device or devices housed in a dial or a bezel according to the invention are activated at the user's demand. Therefore, control means must be provided for the electronic function. These control means may take various forms, three of which are illustrated in the drawing.

Figure 7:
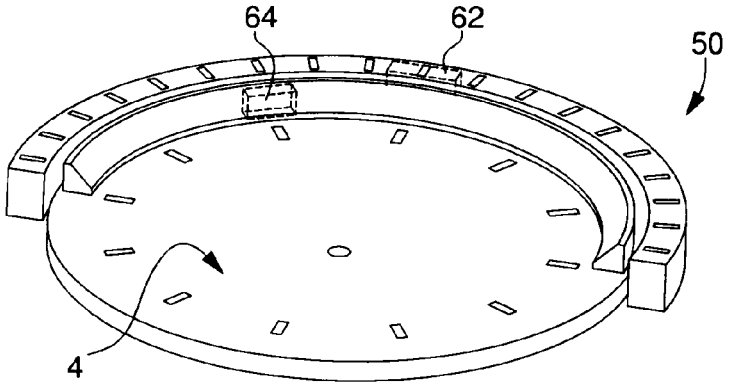
FIGS. 7, 8 and 9 are schematic perspective views illustrating three different control means for an electronic module according to the invention.

According to a first embodiment illustrated in FIG. 7, the control means includes a magnet 62, housed in rotating bezel 50 and a reed contact 64, housed in flange 46 of dial 4. When rotating bezel 50 is pivoted, magnet 62 passes above reed contact 64. Reed contact 64 detects magnet 62 and generates a signal, which is used to control the electronic device.

Figure 8:
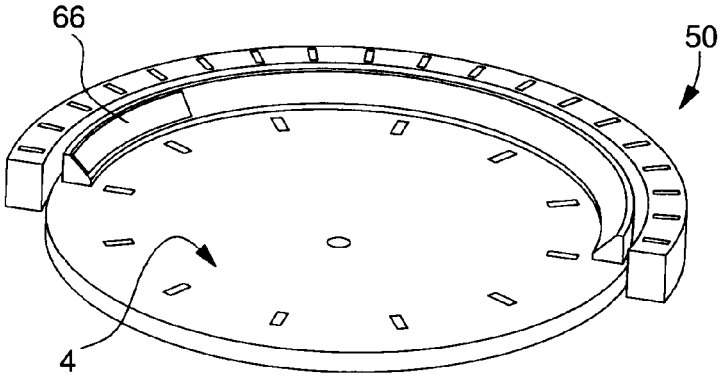
Figure 9:
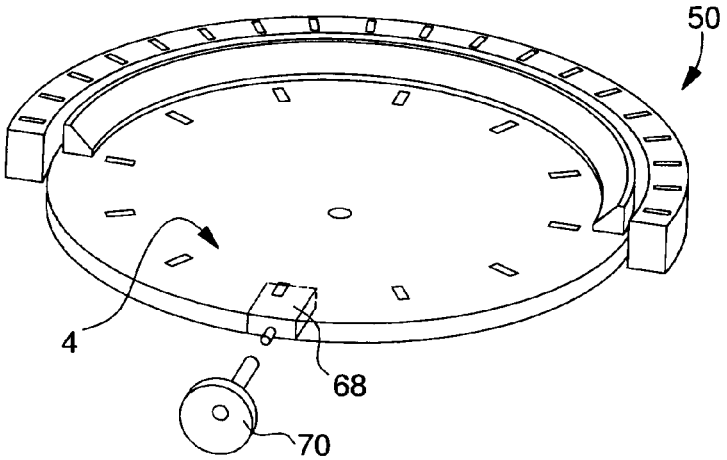

According to a second variant illustrated in FIG. 8, an electrode 66 forming a touch sensitive control button is structured in flange 46.

According to a third variant, an SMD switch 68 is mounted underneath the watch dial and is activated by the user from the exterior of the watch case by means of a push-button 70, which passes through the middle part (not shown) of the watch case.

According to a variant that is not illustrated, the control means may be of the automatic type, such as an accelerometer, which, when it detects an acceleration caused by a movement of the user's arm, will start the electronic function.

It goes without saying that this invention is not limited to the embodiments that have just been described and that various simple alterations and variants can be envisaged by those skilled in the art without departing from the scope of this invention as defined by the annexed claims. Thus, it is possible to envisage integrating one or more electronic functions in other exterior elements than the dial or bezel such as, for example, the wristband or a bracelet link or even the back cover of the watch.

Figure 10:
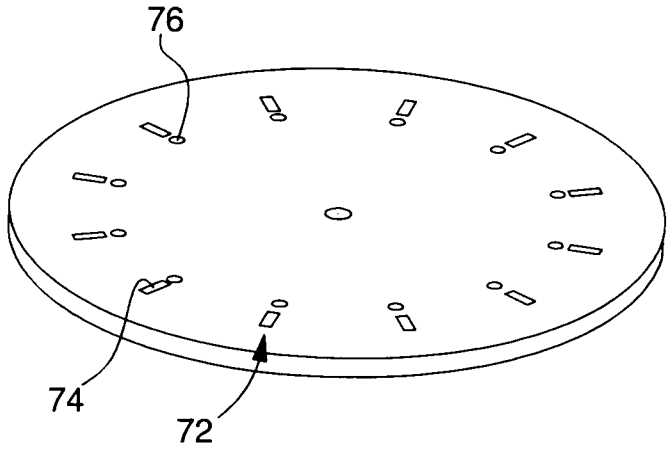
FIG. 10 is a plan view of an alternative embodiment of a watch dial according to the invention.

FIG. 10 is a perspective view of an alternative embodiment of a watch dial member according to the invention. According to this embodiment, the hour symbols on dial 72 are formed by solar cells 74, which are arranged flush with the surface of dial 72 and which power light emitting diodes 76, arranged in the extension of said solar cells. These light emitting diodes 76 are intended to light the hour hand, minute hand and seconds hand by reflection onto crystal 6.

The invention claimed is:

1. A wristwatch, comprising:

a dial comprising a light source and a photovoltaic cell which powers the light source with electric energy, wherein the light source and the photovoltaic cell are housed within a thickness of the dial to form an autonomous electronic module which is completely independent of a wristwatch movement.

2. The wristwatch of claim 1, further comprising:

a rechargeable battery, wherein the photovoltaic cell powers the light source via the rechargeable battery.

3. The wristwatch of claim 2, wherein the rechargeable battery is mounted underneath the dial.

4. The wristwatch of claim 1, further comprising:

a micromotor mounted on the back surface of the dial; and a hand comprising a pipe, wherein the photovoltaic cell is provided with a hole for the passage the pipe, and micromotor drives the hand via the pipe.

5. The wristwatch of claim 1, further comprising:

a crystal covering the dial; and a time hand comprising a layer comprising a fluorescent or phosphorescent pigment, wherein the time hand moves above the dial, and the light source emits an ultraviolet light which is reflected by the crystal and lights the time hand.

6. The wristwatch of claim 5, wherein a surface of the crystal facing the dial comprises a reflective layer, which reflects the ultraviolet light and allows the visible spectrum to pass through the crystal.

7. The wristwatch of claim 1, further comprising:

an hour symbol comprising a solar cell; and a light emitting diode arranged in an extension of the solar cell, wherein the solar cell is flush with a front surface of the dial and powers the light emitting diode.

8. The wristwatch of claim 1, further comprising:

a semi-transparent flange, wherein the photovoltaic cell is arranged in an annular fashion along an external periphery of the dial and concealed from a user's view by the flange.

9. The wristwatch of claim 8, wherein the flange has a cross-section in the form of a right angled triangle, and the light source is arranged in proximity to a base of the flange.

10. The wristwatch of claim 1, further comprising:

an applique and a decorative design, wherein the photovoltaic cell forms the dial and the light source is housed in a cavity arranged in the photovoltaic cell, and the applique and decorative design are provided on a visible surface of the photovoltaic cell with a self-adhesive element or by silk screen printing.

11. The wristwatch of claim 1, further comprising:

an electronic device;

an electronic device control element; and an exterior element, wherein the control element is integrated in the exterior element.

12. The wristwatch of claim 11, wherein the control element is formed by a magnet and a reed contact, an electrode forming a touch sensitive button, a surface mounted device switch controlled by a push-button, or an automatic element.

13. The wristwatch of claim 12, further comprising:

a flange; and a bezel, wherein the magnet is housed in the bezel and the reed contact is housed in the flange, or the electrode is structured on a surface of the flange.

* * * * *

UNITED STATES PATENT AND TRADEMARK OFFICE

CERTIFICATE OF CORRECTION

PATENT NO. : 8,787,120 B2
APPLICATION NO. : 13/386863
DATED : July 22, 2014
INVENTOR(S) : Fleury et al.

It is certified that error appears in the above-identified patent and that said Letters Patent is hereby corrected as shown below:

On the title page, Item [30] should read:

--[30] Foreign Application Priority Data

Sept. 1, 2009 (EP).....09169173.3--

Signed and Sealed this
Twenty-fifth Day of November, 2014

Michelle K. Lee

Michelle K. Lee
*Deputy Director of the United States Patent and Trademark Office*